United States Patent [19]

Lachenmeier

[11] Patent Number: 5,008,991

[45] Date of Patent: Apr. 23, 1991

[54] DEVICE AND PROCESS FOR INTERMINGLING A BUNDLE OF THREADS USING A TURBULENT AIR STREAM

[75] Inventor: Andreas Lachenmeier, Widnau, Switzerland

[73] Assignee: Viscosuisse S.A., Emmenbrucke, Switzerland

[21] Appl. No.: 362,388

[22] PCT Filed: Sep. 23, 1988

[86] PCT No.: PCT/CH88/00170

§ 371 Date: May 24, 1989

§ 102(e) Date: May 24, 1989

[87] PCT Pub. No.: WO89/02942

PCT Pub. Date: Apr. 6, 1989

[30] Foreign Application Priority Data

Sep. 30, 1987 [CH] Switzerland ..... 3793/87

[51] Int. Cl.[5] ..... D02J 1/08; D02G 1/16

[52] U.S. Cl. ..... 28/271

[58] Field of Search ..... 28/271, 272, 273, 274, 28/276

[56] References Cited

U.S. PATENT DOCUMENTS

| | | | |
|---|---|---|---|
| 3,261,071 | 7/1966 | Clendening et al. | 28/272 |
| 3,333,313 | 8/1967 | Gilmore et al. | 28/272 X |
| 3,665,566 | 5/1972 | Ohayon | 28/275 |
| 4,040,154 | 8/1977 | Riley | 28/273 X |
| 4,217,323 | 8/1980 | Foster et al. | 28/271 X |
| 4,345,425 | 8/1982 | Negishi et al. | 28/271 X |
| 4,565,524 | 1/1986 | Rünkel et al. | 28/272 X |
| 4,592,119 | 6/1986 | Bauer et al. | 28/185 X |
| 4,644,620 | 2/1987 | Maeda | 28/220 |
| 4,644,622 | 2/1987 | Bauer et al. | 28/272 X |

OTHER PUBLICATIONS

Demir, A., "Intermingling/Interlacing: A Broad Survey", Second International Conference on Airjet Texturizing and Mingling/Interlacing at Longhborough, UK, Sep. 1989.

*Primary Examiner*—Werner H. Schroeder
*Assistant Examiner*—Bradley Kurtz DeSandro
*Attorney, Agent, or Firm*—Felfe & Lynch

[57] ABSTRACT

Device for drying a bundle of threads between a stretching trough and a sizing trough has a tiered array of elongate nozzle bodies each having a plurality of thread channels therein for receiving a partial bundle of threads therethrough. Each channel has a cross section consisting of a semicircular bottom part of radius r and a rectangular top part of width 2r and height r, the semicircular bottom part having a centered air inlet for generating turbulence to dry the threads. The channels are closed by a metal cover which is received flushly against a cover contact surface having an air checking borehole which assures that the cover is in place. A preferred embodiment has channels with restricted inlet and outlet parts to facilitate generating knots of turbulent air in a central turbulent part of the channel.

20 Claims, 3 Drawing Sheets

A-A

DEVICE AND PROCESS FOR INTERMINGLING A BUNDLE OF THREADS USING A TURBULENT AIR STREAM

BACKGROUND OF THE INVENTION

The invention relates to a device for intermingling a bundle of wet threads of smooth multifilament in a turbulent air stream. The device includes a nozzle body with U-shaped thread channels and a centered inlet or bore hole for compressed air assigned to each thread channel. The invention further relates to a process for intermingling the bundle of threads in a turbulent air stream.

In order to obtain good weaving properties of smooth textile multifilament threads, a sizing is usually required. Intermingling the threads in a turbulent air stream supports the sizing effect so that the weaving properties are improved or the degree of sizing can be maintained at a lower level. The turbulent air stream treatment serves to keep the fibrils close enough to each other so as to permit a gluing by the sizing agent. Weak knots of air serve this purpose, especially if the turbulent air stream treatment is performed directly before the sizing trough, since there is little stress applied to the threads and only a few knots are lost. Weak knots of turbulent air in short, regular distances are more appropriate than stronger knots in larger and thus irregular distances. Stronger knots also present the risk of showing traces in the fabric.

The knots can be influenced by the diameter of the thread channel. A large thread channel results in tight knots of air in relatively large distances; a small diameter results in more loose knots in smaller, more regular distances.

Stretch-sizing of multifilament threads made of thermoplastics, especially made of polyamide and polyester but also polyethylene and polypropylene, employs a wet thread which is treated in a turbulent air stream between a stretching trough, usually containing water, and a sizing trough; the adherent water is blown off during the air stream treatment using a suitable device.

The diameter of the thread channel influences the air stream treatment; while it has to be narrow to blow off the water with a minimum of air, there is a restriction in selecting the kind of turbulent air stream treatment of wet threads. While relatively loose knots are sufficient to support the sizing effect, this will not be a disadvantage to the stretch sizing, where the threads are hardly exposed to stress between the turbulent air stream treatment and the sizing trough.

Devices for intermingling a bundle, of threads made of dry filament threads in a turbulent air stream are known (U.S. Pat. No. 4,644,622). The known device includes a rotatable nozzle body, provided with tube-like turbulence nozzles each having a slot; these nozzles are closed during operation. The thread guiding channel is rectangular, and the thread is guided diagonally in this thread channel. This device is appropriate for the treating of certain titers of dry threads in a turbulent air stream during the warping or stretch-warping process. There is no information provided on the efficiency and the turbulence device and its air consumption. A disadvantage is the time-consuming inserting of the bundle of threads.

From the EP-A 0 121 010 a turbulence device with turbulence nozzle is known for the manufacture of an interlaced yarn. The device is equipped with a U-shaped turbulence channel. Although the turbulence improved, the consumption of compressed air is still much too high.

EP-A 0 144 617 describes a process for the manufacture of a chain which includes stretching in a water bath, followed by a turbulent air stream treating, and a subsequent sizing process. The description does not give any details on the kind of turbulence involved.

It is a disadvantage of the known wet stretching process that the liquid adherent to the thread must be mostly removed before entering the turbulent air stream device in order to prevent a dilution of the sizing liquor. This is achieved by an upstream system of squeeze rolls. A squeezer disposed downstream of the stretching trough removes the water only insufficiently, i.e., only about 50% of the water is removed.

All known nozzles have disadvantages. They use too much air or damage the thread. Most of the turbulence nozzles operate with dry threads, achieving satisfactory results in a certain titer range. Employing wet threads, however, leads to a rapid efficiency decrease due to the fact that the water is removed insufficiently, resulting from an insufficient turbulence of the bundle of threads.

Another disadvantage of the known turbulence devices is that each individual thread must be carried into the eyes and combs before and after the thread channels, which is very time-consuming.

SUMMARY OF THE INVENTION

It is the object of the invention to create a device for intermingling a bundle of filament threads, especially while employing stretch sizing, in a turbulent air stream; the device ensures a correct turbulence without damaging the thread while the surface water is removed at a low air consumption rate.

It is furthermore an object of the invention to provide a process which permits the turbulent intermingling of a large number of threads and avoids the insertion of the individual threads into the eyes. The thread density (threads/cm) must remain constant before and after the turbulence device.

The nozzle body is provided with at least two U-shaped thread channels and a borehole in the support area for a removable cover. Each thread channel represents in cross-section view a semicircular section of radius r and a rectangular section of width 2r and height r.

It proved to be advantageous to provide the thread channel with a cover. The cover can be removed for easy insertion. The air borehole shall be provided in the middle of the thread channel.

If the air speed within the thread channel is high enough, the major part of the surface water is blown off in counterdirection to the thread movement, hence, the central air borehole can be considered to be the place of separation between the wet area and the dry area. The exiting thread is completely free of surface water and feels dry.

It is particularly advantageous that the bottom part of the thread channel, provided with a rectangular centered air channel, has a semicircular cross section. The thread can be guided in the center of a circle while the lumen of the circle is not narrowed by a flat cover. Furthermore, this configuration of the nozzle body has significant advantages from a manufacturing point of view. Employing simple tools, an exact thread channel without sharp edges can be produced by means of milling.

A further embodiment features a thread channel with narrowed ends at the thread inlet and outlet, permitting a better liquid drainage of the wet thread. If the thread channel is narrow at its inlet and outlet but broader in the middle, there is sufficient space for a turbulent air stream treating and the water can still be blown off by the high air speed.

The cover is advantageously made of a metal plate with a thickness of 30–50 mm, preferable 40 mm, with plane-parallel surfaces. It can be removed, pivoted, or slid to expose the thread channel to permit inserting the bundle of threads. The flat closure has the advantage that it can be manufactured simply and that it fits well. Boreholes or recesses to supplement the thread channel in the nozzle body are not necessary. Hence, a complicated cover configuration is not required.

The cover closure is monitored advantageously by means of compressed air via a check borehole in the nozzle body. If the cover fits correctly, compressed air cannot escape through this borehole. The cover is held fast by its own weight (40 mm steel), since there is not enough space left to fasten it between the thread channels.

It is advantageous to restrict the length of the thread channel to 3 to 12 cm, while a length between 3 and 10 cm is preferred. The best results are achieved with a thread channel length of 10 cm. The diameter of the thread channel, however, is significant and lies between 1.5 and 2.5 mm. It is advantageous to select a diameter of 2.2 to 2.5 mm for coarse fibril titers ranging from 5 to 7 dtex, and a diameter of 1.5 to 2.0 mm for fine fibril titers, e.g. up to 3.5 dtex. In order to ensure a sufficiently intensive turbulent air stream treating of a thread, e.g. dtex 167 f 30, 5.6 dtex/fibrils, a thread channel diameter of more than 2 mm is required.

If a thread channel is too large, the turbulence is bad, the watery liquid is not blown off, and the water which is adherent to the thread coming from the stretching trough then strongly dilutes the subsequent size. If the turbulence is bad, the distance between the knots increases, thus creating more and more open spaces which finally reduce the running properties of the threads. If the thread channel is too narrow, depending on the fibril titer, the turbulence of the bundle of threads is also reduced. Knots at 167 f 30, for example, with a thread channel of less than 2 mm diameter are so weak that the needle method cannot be applied anymore.

Hard anodized aluminum proved to be a particularly suitable material for the nozzle body with the thread channel. Chemical polishing before the anodic oxidation can prevent serimetry damages which occur during the turbulence. A black coloring also permits a particular visibility of a white thread. It is advantageously that the anodizing layer have a thickness of about 50 um which ensures a long life. The thread channels can be inspected for cleanliness and general condition.

It is also advantageous to offset the nozzle bodies below each other in direction of the thread movement so that the blown off water fall back onto the wet incoming threads and not on the already dried threads.

Each individual thread of a bundle of threads consisting of filament threads is directed parallel to the longitudinal axis of the turbulence chamber; the turbulence is performed at 100 to 600 m/min, preferably at 200 to 400 m/min while the speed is determined by the sizing process. According to titer and number of knots/m, the relative air consumption is less than 1.5 $Nm^3/h$ and thread at 3 bar air pressure. At these speeds, the number of knots is independent from the speed employed. The turbulence effect can be improved if the thread of a bundle of threads is passed over the air borehole as a small ribbon.

It is advantageous to guide the thread ribbon between a horizontally and a two vertically disposed thread guides outside of and before the thread channel. For this purpose, a horizontally disposed ceramic guide can be provided before and after the thread channel at a distance, for example, of 1 cm and two vertically disposed thread guides (combs) at a distance of 3 cm. The distance between the threads should be at least 5 mm to avoid an entanglement of the wet threads. Therefore, such a bundle of threads must be subdivided into several partial bundles during the treating in the turbulent air stream. For example, it is advantageous to subdivide a bundle consisting of 8 threads into 4 partial bundles consisting of 2 threads/cm=5 mm distance. A relatively coarse titer with e.g. dtex 167 f 30 having a relatively small air borehole of appr. 0.8 mm, as compared to known nozzle boreholes for the same titer, is already sufficient for the turbulence device in accordance with the invention; this also accounts for the low consumption of compressed air.

It is advantageous to redirect the thread before and after the thread channel by 5 to 20 degrees via a horizontal thread guide. The angle results from the configuration of the nozzle bars. It is not possible to have the same angles at all the places where turbulence is performed. At the same time it must be ensured that sufficient distance is provided from the vertical thread guides (combs) to the horizontal thread guides and that the redirection at the vertical thread guide is not too great. The vertical thread guides must not approach the horizontal guides; this prevents the thread from lying flatly.

In order to avoid a dilution of the sizing liquor, the water coming from the stretching trough must be completely removed. The drainage of the surface water requires an amount of air along the thread of at least 0.1 $Nm^2/h$ per $mm^2$ of thread channel cross section. The remaining moisture of polyester is at less than 1%, and for polyamide under 10%. Falling below this air speed results in incomplete blowing off of the water and in a significant turbulence decrease.

The simultaneous insertion of a multitude of threads into the thread channels of the nozzle body, which is possible through the removable covers of the nozzle bodies, has the advantage that a partial bundle of threads can be inserted as a whole by means of an adhesive tape without separate insertion into the individual nozzles. The partial threads are thus recombined in the original thread density. An enormous saving of working time is another obvious advantage.

At the end of the specification is a table providing the measured results for a thread manufactured with a turbulence nozzle according to the invention as compared to a known nozzle.

DETAILED DESCRIPTION OF THE PREFERRED EMBODIMENT

Figure 1:
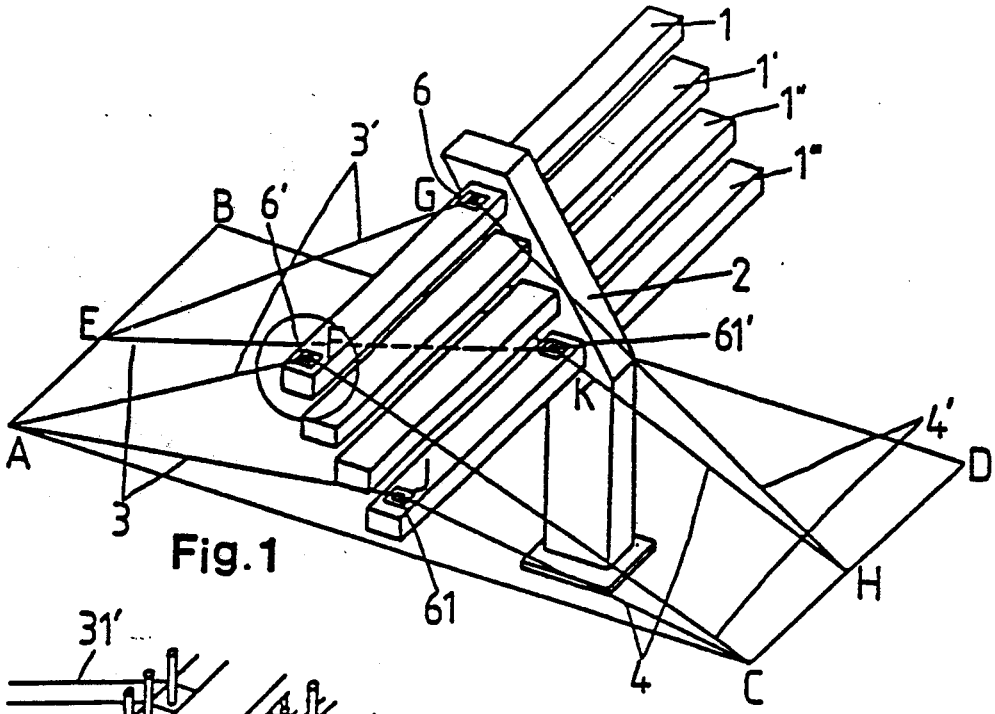
FIG. 1 perspective view of a device with eight nozzle bars for intermingling a bundles of threads in turbulent air stream.

FIG. 1 shows diagrammatically a perspective view of a device for intermingling a bundle of threads in a turbulent air stream in accordance with the invention. The examples are four nozzles bars 1, 1', 1'', 1''' each disposed symmetrically on both sides of the support 2 in a vertically and stepwise offset arrangement. Each nozzle bar 1 contains an air passage as a supply for the turbulence body and the thread guides. Support 2 contains in addition the compressed air supply. A wet bundle of threads (50% water cover) coming from a water-containing stretching trough, which is not represented, is in its width subdivided into two parts in order to avoid contact with support 2. In the height, the bundle is subdivided in many partial bundles, of which partial bundles 3 and 3' are represented. Depending on its length, each nozzle bar 1, in turn, is supplied with a number of nozzle bodies 6; the example represents on nozzle bar 1 the nozzle bodies 6 and 6' and on nozzle bar 1''' the nozzle bodies 61 and 61'. After passing through nozzle bars 1, 1', 1'' or 1''' the now dry bundles of thread, top bundle 4' and bottom bundle 4 of which are represented, are reunited and fed to a sizing bath which is not represented.

A E F G C H refer to the limitation of the top partial bundle of threads of one half of the support frame and A E J K C H designate the bottom partial bundle of threads. A E F G=3'; A E J K=3; J K C H=4; F G C H=4'.

Since the water is blown off of the incoming thread bundles 3 in the thread channels 7, the nozzles bars have a wet side at the thread inlet and a dry side at the thread outlet. Therefore, the nozzle bars 2 are offset stepwise so as to permit the water only to drop on the wet threads.

Figure 1A:
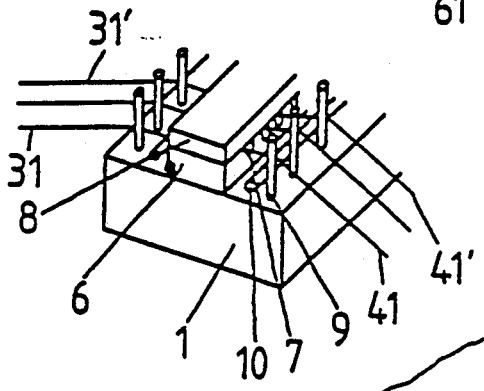
FIG. 1*a* an enlargement of a nozzle bar with a nozzle body, a cover and thread guide FIG. 2 perspective view of a location of turbulence with the cover lifted FIG. 3 cross section view of the nozzle body FIG. 4 overhead view of the nozzle body FIG. 5 a longitudinal section view of a thread channel in the turbulence area according to A—A of FIG. 3

FIG. 1*a* represents a nozzle body 6 as it is disposed on nozzle bar 1. Conventionally, a nozzle body 6 is provided with ten to twenty thread channels 7 which are covered by cover 8.

Vertically disposed thread guides 9 and horizontally disposed thread guides 10 are disposed on nozzle bar 1. Each nozzle bar 6 is supplied with a partial bundle of threads 31, of which ten to twenty wet filament threads pass through each thread channel 7, which they exit as dry filament threads 41 treated in a turbulent air stream.

Figure 2:
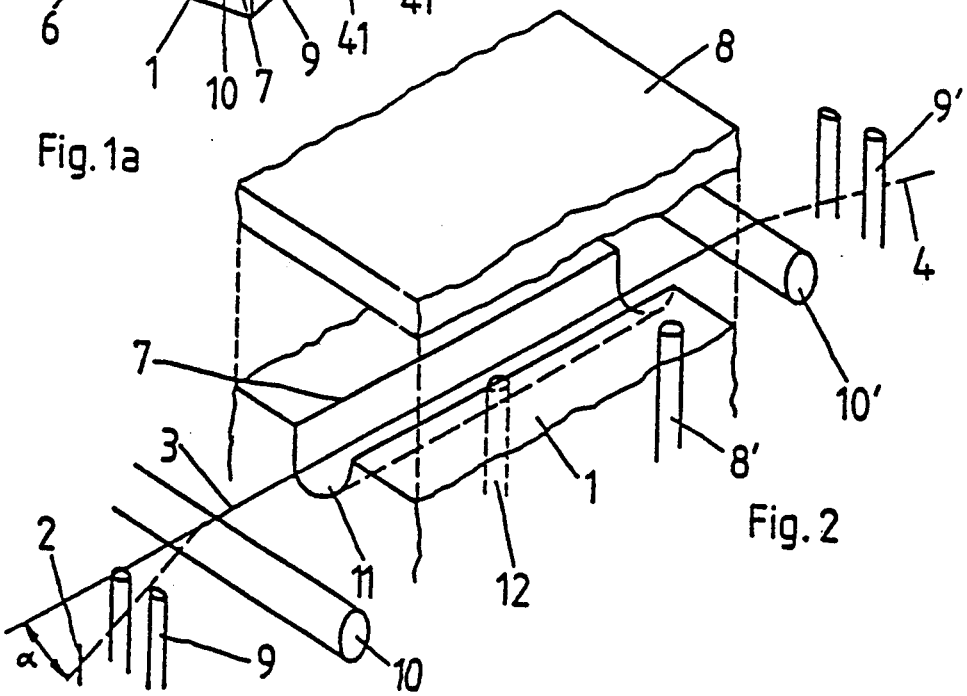

FIG. 2 represents a perspective view of a thread channel 7 in a nozzle body with cover 8 lifted. The bottom part of channel 7 is configured as a groove which is provided with a centered borehole 12 for compressed air. An air checking borehole 8' is disposed in the cover contact surface of nozzle body 6; it is closed if cover 8 fits correctly and serves as a means for monitoring cover closure. A wet thread 3 is fed to channel 7 via a vertical thread guide 9 and a horizontal thread guide 10; it exits channel 7 as a dry thread 4 via a horizontal thread guide 10' and a vertical thread guide 9' and is introduced into a sizing bath. For a redirection by an angle $\alpha$, the thread 3 is put flat at thread guide 10, thus creating a ribbon which increases the turbulence. In order to avoid problems when the thread is put flat, there must be a sufficient distance between the thread guide 9 and thread guide 10, for example about 2 cm, and the redirection at thread guide 9 should be relatively small.

Figure 3:
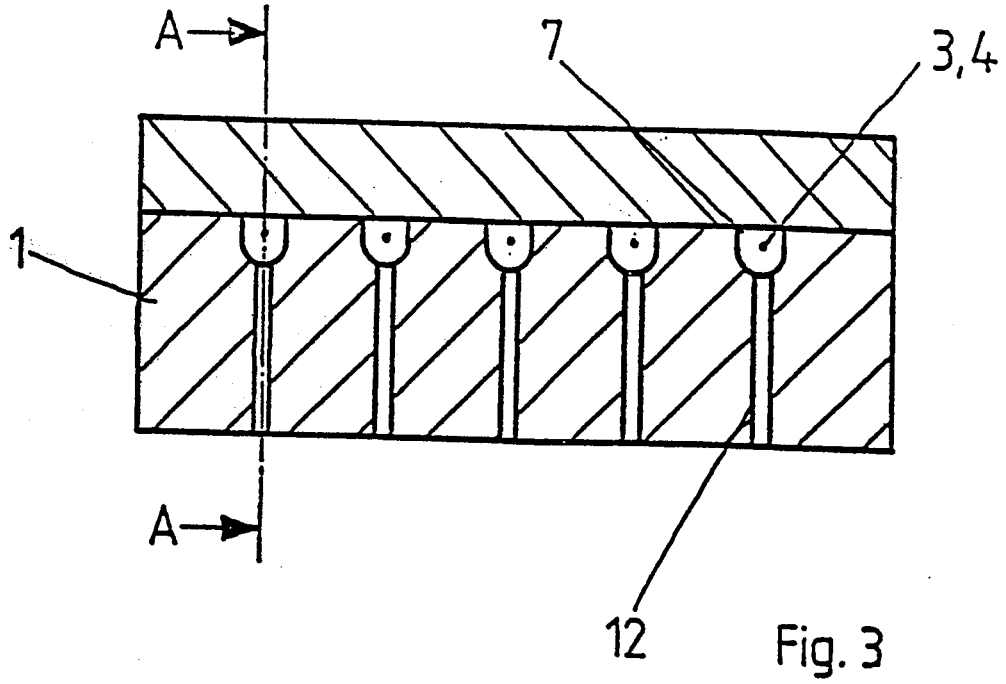

FIG. 3 represents a section view of nozzle body 1 provided with a multitude of thread channels 7 with the respective boreholes 12; the cover 8 is closed in this representation. The threads 3, 4 run approximately in the center of thread channel 7.

Figure 4:
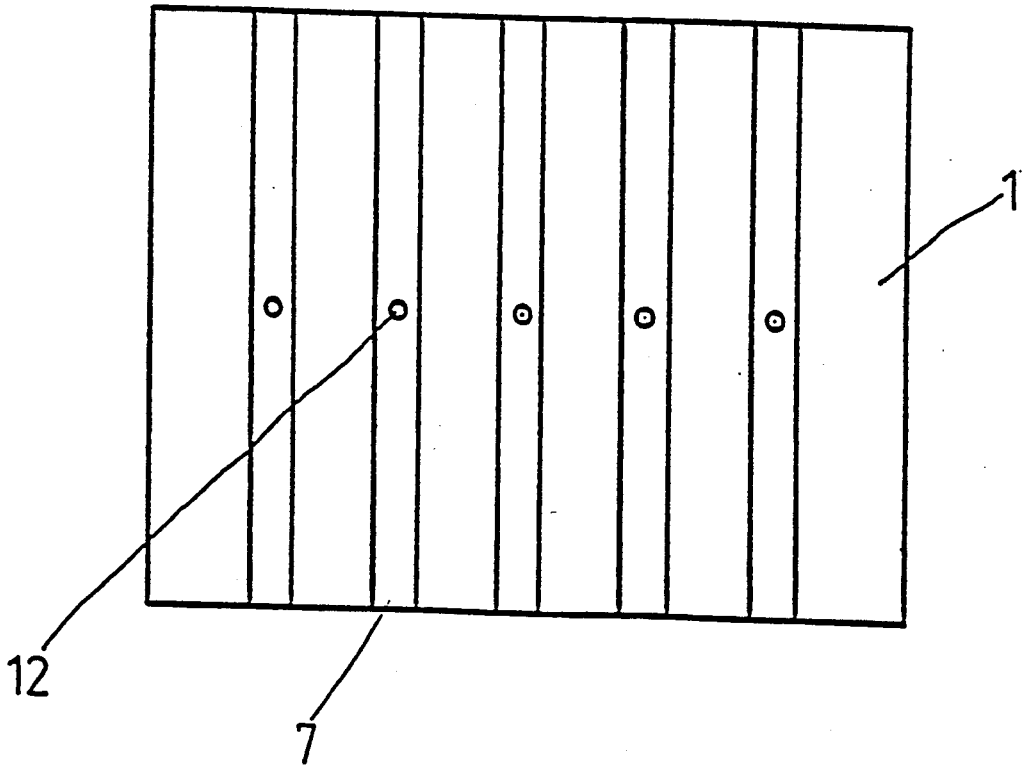

An overhead view according to FIG. 4 demonstrates, while the cover is open, several thread channels 7 of the nozzle body 1 with boreholes 12 for air supply. The distances between the individual thread channels amount to a multiple of the distances between the incoming and outgoing bundle of threads.

Figure 5:
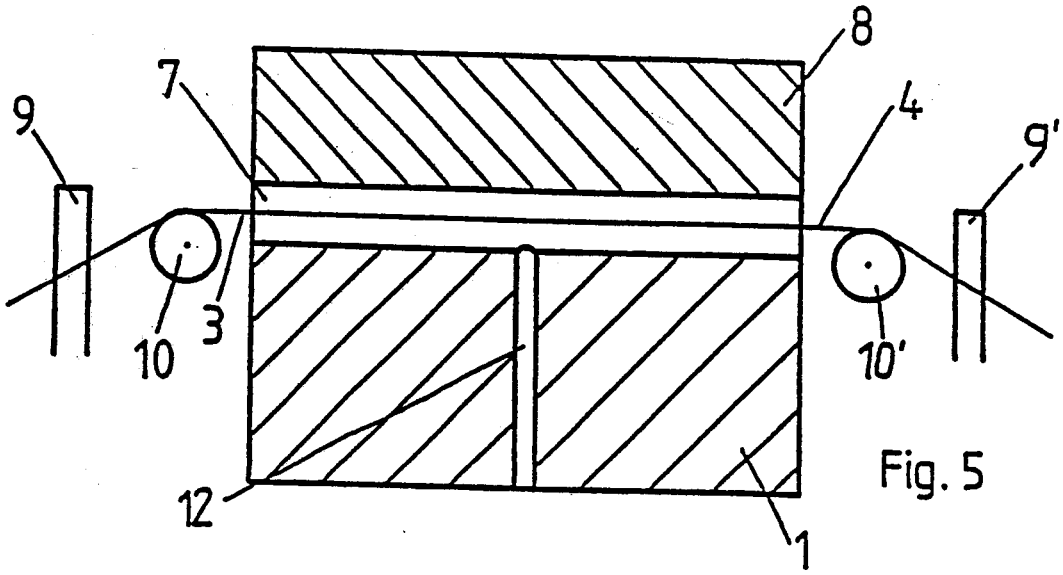

FIG. 5 is a longitudinal section view of thread channel 7 of nozzle body 1 during operation with the cover closed. After passing borehole 12, the partial bundle of threads 3, supplied with compressed air of 1 to 4 bar, becomes partial bundle of threads 4, treated in a turbulent air stream.

Figure 6:
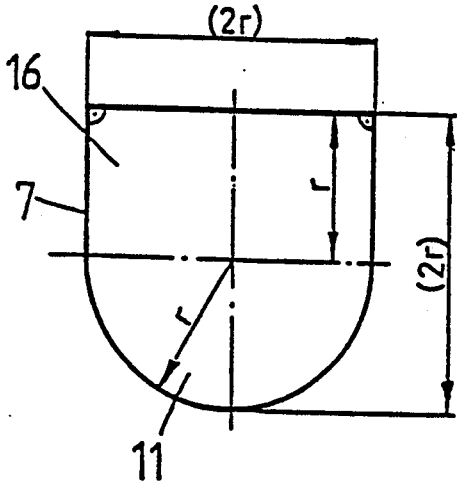
FIG. 6 a cross section of an enlarged thread channel in the turbulence area

FIG. 6 provides the dimensions of thread channel 7 in optimal configuration according to the invention. It is obvious that section 11 represents a semicircle with radius r; the diameter and the height of thread channel 7 correspond to twice the radius r of semicircular section 11; the top represents a rectangle 16 with the height r and the width 2r.

Figure 7:
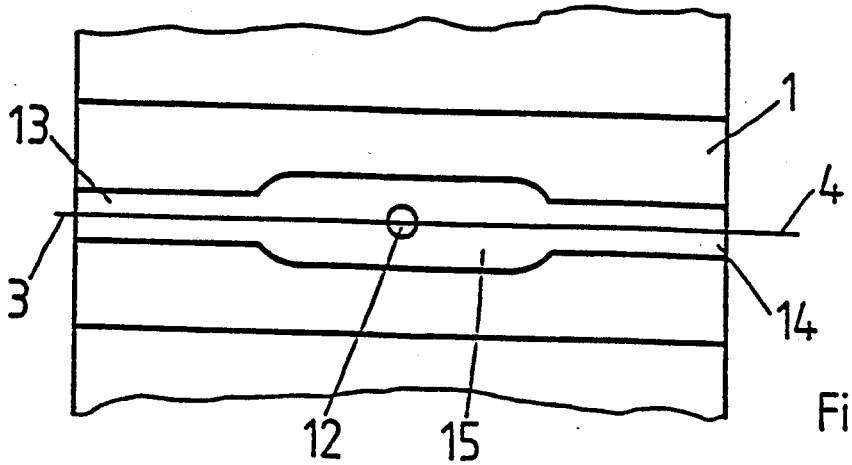
FIG. 7 overhead view of a variant of a thread channel with the cover open.

FIG. 7 is a variant of thread channel 7 including the actual turbulence channel 15 in the center and a front inlet part 13 for partial bundle of threads 3 before turbulence and an outlet part 14 for partial bundle of threads 4 after turbulence which is performed by means of compressed air coming from a borehole 12 of a compressed air supply which is not represented. The high air speed blows off the water along the thread at 13. The length of the turbulence part 15 is about three times its diameter.

During operation, a comb (not shown) serves, for feeding purposes according to FIG. 1, to separate a bundle of threads in its width AB into individual partial bundles of threads. The partial bundles of threads 3 to 3' are separated in order with an adhesive tape and thus inserted into the open nozzle body 6 and on width AB of a not represented comb. In the area CD, the partial bundles of threads 4 to 4' after undergoing turbulence are recombined, for example, to 8 threads per cm.

The turbulence is determined by the diameter of turbulence chamber 15; large diameters produce strong knots of air in large, irregular distances and small diameters smaller knots of air in smaller, regular distances. A small diameter of inlet part 13 and outlet part 14 causes high air speeds along the moving partial bundle of threads 3, 4 and results in good water drainage. The nozzles in accordance with the invention permit to obtain, despite the wet threads, a turbulence with long, strong knots of air.

The table following the specification provides the measuring results of a thread manufactured with a turbulence nozzle in accordance with the invention as compared to one of the known nozzles. For all examples the thread tension was at 0.05 cN/dtex.

The device in accordance with the invention combines the following advantages:

simple insertion of a thread into the open nozzle bodies;

the thread spacing in a partial bundle of threads corresponds to a whole number multiple of the number of threads incoming and outgoing, so that the partial bundles of threads can be separated by an adhesive, inserted as a bundle, and recombined to form a complete bundle at the exit low air consumption;

no serimetry damages;

complete blowing off of surface water;

no efficiency decrease caused by water;

sufficient turbulence intensity even for more coarse titers;

The device in accordance with the invention is particularly suited for the intermingling of a bundle of threads consisting of wet, smooth, synthetic filament threads in a turbulent air stream when stretch sizing is employed and the turbulence takes place between two operational steps. The treating in a turbulent air stream as described can even be performed in the warping department, which permits using non-treated threads in the warping department. With the turbulence nozzles in accordance with the invention, the turbulence effect loss is smaller than if running via travellers, cops, thread brake, railing and so forth.

| | | Polyester (Polyethylene terephthalat) 167 f 30 | | Polyamide (Nylon) 78 f 23 | |
|---|---|---|---|---|---|
| Titer dtex | | invention | prior art | invention | prior art |
| speed | m/min | 200 | 143 | 200 | 171 |
| air pressure | bar | 3.5 | 3.8 | 3.0 | 3.0 |
| nozzle borehole | mm | 0.8 | 1.2 | 0.8 | 1.2 |
| air consumption | $Nm^3/h$ | 1.3 | 3.14 | 1.2 | 2.6 |
| per nozzle | $Nm^3/kg$ | 6.5 | 20.4 | 12.6 | 28.5 |
| turbulence | Kn/m(1) | 15 | 13.2 | 30 | 24 |
| titer after | dtex(2) | 167 | 180 | 77 | 86 |
| turbulence strength | cN/tex(2) | 43 | 32 | 49 | 35.5 |
| breaking elongation | %(2) | 28 | 27.3 | 38 | 34 |

(1)measured according to the needle test method (2)The same breaking elongation was aimed for in all tests. Due to serimetry damages at the known nozzle, the stretching was corrected correspondingly. The result is a titer slightly too high and a strength which is slightly too low.

I claim:

1. Device for intermingling a wet bundle of threads composed of smooth multifilaments in a turbulent air stream, including a nozzle body with transverse U-shaped thread channels, each thread channel having an inlet part, an outlet part, and a turbulence part therebetween, said turbulence part having a length in the direction of thread movement and a diameter transverse thereto, said length being greater than said diameter, said turbulence part having a centered compressed air inlet, the diameter of the inlet part and the outlet part being smaller than the diameter of the turbulence part.

2. Device in accordance with claim 1, characterized in that the nozzle body and the thread channel are made of aluminum.

3. Device in accordance with claim 2, characterized in that the surfaces of the thread channels and the inside of the cover are hard anodized in black in a thickness of at least 50 micrometer.

4. Device in accordance with claim 1, characterized in that the thread channel has a length of 3 to 12 cm.

5. Device in accordance with claim 1, characterized in that several nozzle bodies are vertically disposed on a support offset, and in running direction of the thread.

6. Device as in claim 1, wherein said nozzle body has a cover contact area which receives said cover flushly thereagainst to close said channel, said body having a checking air borehold in said cover contact area to check for proper closure of said cover.

7. Device in accordance with claim 1 wherein the length of the turbulence part is about three times the diameter of the turbulence part.

8. Device in accordance with claim 1 wherein the nozzle body has a removable cover which fits over the thread channels, each thread channel representing in cross section a semi-circular section of radius r and a rectangular section of height r and width 2r.

9. Device in accordance with claim 8, characterized in that the cover is configured as a flat metal plate with a thickness of at least 40 mm.

10. Device in accordance with claim 8, characterized in that the thread channel has a diameter 2r of 1.5 to 2.5 mm.

11. Process for intermingling a wet bundle of threads composed of smooth multifilaments, characterized in that the bundle is separated into partial bundles which are each guided through a closed thread channel in a nozzle body parallel to the longitudinal axis of the thread channel, said thread channel having, an inlet part, an outlet part, and a turbulence part therebetween, the turbulence part having a length in the direction of thread movement and a diameter transverse thereto, said length being greater than said diameter, said turbulence part having a centered compressed air inlet, the diameter of the inlet part and the outlet part being smaller than the diameter of the turbulence part, and in that each partial bundle is treated in a turbulent air stream at a bundle speed of 100 to 600 m/min using an amount of air within the thread channel of at least 0.1 $N^3/h$ per $mm^2$ of channel cross section.

12. Process in accordance with claim 11, characterized in that each partial bundle of threads is guided as a yarn ribbon before entering the thread channel.

13. Process in accordance with claim 12, characterized in that a multitude of threads are simultaneously inserted into the thread channels of the nozzle body.

14. Process in accordance with claim 12, characterized in that, the spacing between the thread channels of the nozzle bodies is a whole number multiple of the number of distances between the incoming and outgoing threads.

15. Process in accordance with claim 12, characterized in that each partial bundle of threads is guided by horizontal thread guides and vertical thread guides which are disposed outside of the thread channel.

16. Process in accordance with claim 12, characterized in that each partial bundle of threads is redirected through an angle of 5 to 20 degrees.

17. Process as in claim 11 wherein the length of the turbulence part is about three times the diameter of the turbulence part.

18. Process as in claim 11 wherein the channel has a cross section with a semi-circular section of radius r and a rectangular section of width 2r and height r.

19. Process in accordance with claim 11, characterized in that each partial bundle of threads is guided by horizontal thread guides and vertical thread guides which are disposed outside of the thread channel.

20. Process for treating a wet bundle of threads composed of smooth multifilaments, characterized in that the bundle is separated into partial bundles which are each guided through a closed thread channel parallel to the longitudinal axis of the thread channel, each partial bundle of threads being guided as a yarn ribbon before entering the thread channel, and in that each partial bundle is treated in a turbulent air stream at a bundle speed of 100 to 600 m/min using an amount of air within the thread channel of at least 0.1 $nm^3/h$ per $mm^2$ of channel cross section.

* * * * *

UNITED STATES PATENT AND TRADEMARK OFFICE

CERTIFICATE OF CORRECTION

PATENT NO. : 5,008,991

DATED : April 23, 1991

INVENTOR(S) : Andreas Lachenmeier

It is certified that error appears in the above-identified patent and that said Letters Patent is hereby corrected as shown below:

Col. 8, line 59 (Claim 11), delete "$N^3/h$" and insert --$Nm^3/h$--.

Col. 10, line 14(Claim 20), delete "$nm^3/h$" and insert --$Nm^3/h$--.

Signed and Sealed this

Twenty-second Day of June, 1993

*Attest:*

*Attesting Officer*

Michael K. Kirk

MICHAEL K. KIRK

*Acting Commissioner of Patents and Trademarks*